United States Patent [19]

McDuffie

[11] 4,387,881

[45] Jun. 14, 1983

[54] BARGE JACKING APPARATUS

[76] Inventor: Thomas F. McDuffie, 11926 Taylorcrest, Houston, Tex. 77024

[21] Appl. No.: 280,062

[22] Filed: Jul. 2, 1981

[51] Int. Cl.[3] ..... E02B 17/04

[52] U.S. Cl. ..... 254/89 H; 254/95; 254/105

[58] Field of Search ..... 254/95, 105, 89 H; 187/19; 405/196

[56] References Cited

U.S. PATENT DOCUMENTS

| | | | |
|---|---|---|---|
| 1,929,837 | 10/1933 | Cathcard | 254/95 |
| 2,765,201 | 10/1956 | Phillips | 254/95 |
| 3,014,346 | 12/1961 | Small | 254/95 |
| 3,674,240 | 7/1972 | Larsson | 254/95 |
| 4,203,576 | 5/1980 | Sutton | 254/95 |

*Primary Examiner*—Robert C. Watson

*Attorney, Agent, or Firm*—Gunn, Lee & Jackson

[57] ABSTRACT

For use with an offshore drilling barge, a jacking apparatus is disclosed which utilizes racks mounted on the leg to be elevated, there being two or more racks on each leg, and the racks are equipped with teeth and spaces where teeth are omitted. There is attached to the barge a cooperative, fixed rack and a pinion carried on the end of a piston rod connected with a hydraulic piston. The pinion is located and has teeth appropriate to fit between the rack on the leg and the fixed rack on the barge. By aptly spacing the gaps in the several racks on the leg, racks can be omitted for significant lengths, and, additionally, the pinion can be periodically disengaged to enable rapid extension or retrieval of the pinion.

11 Claims, 8 Drawing Figures

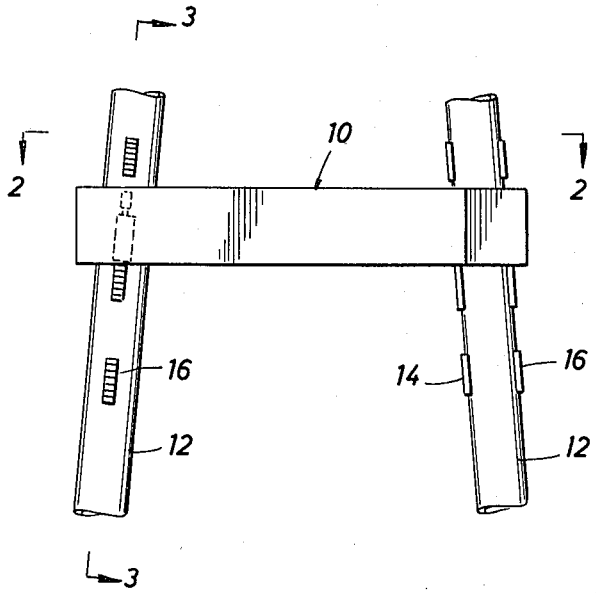
FIG. 1
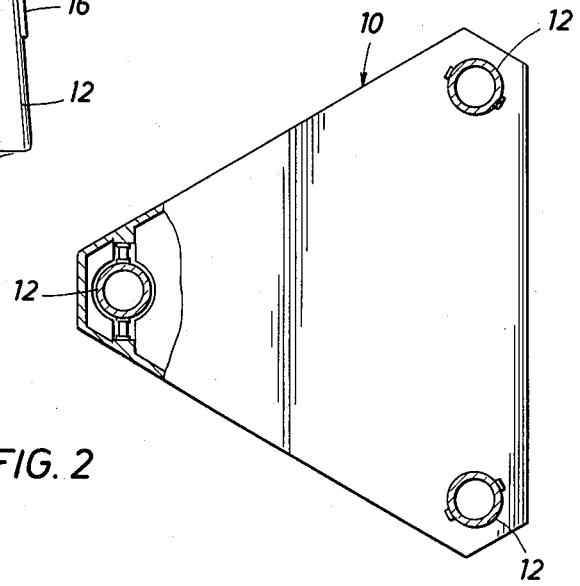
FIG. 2
FIG. 5
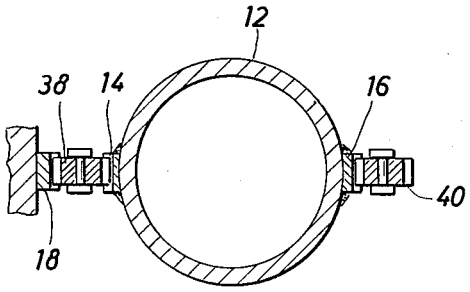
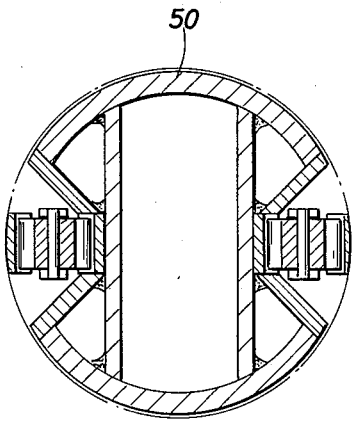
FIG. 6

FIG. 7
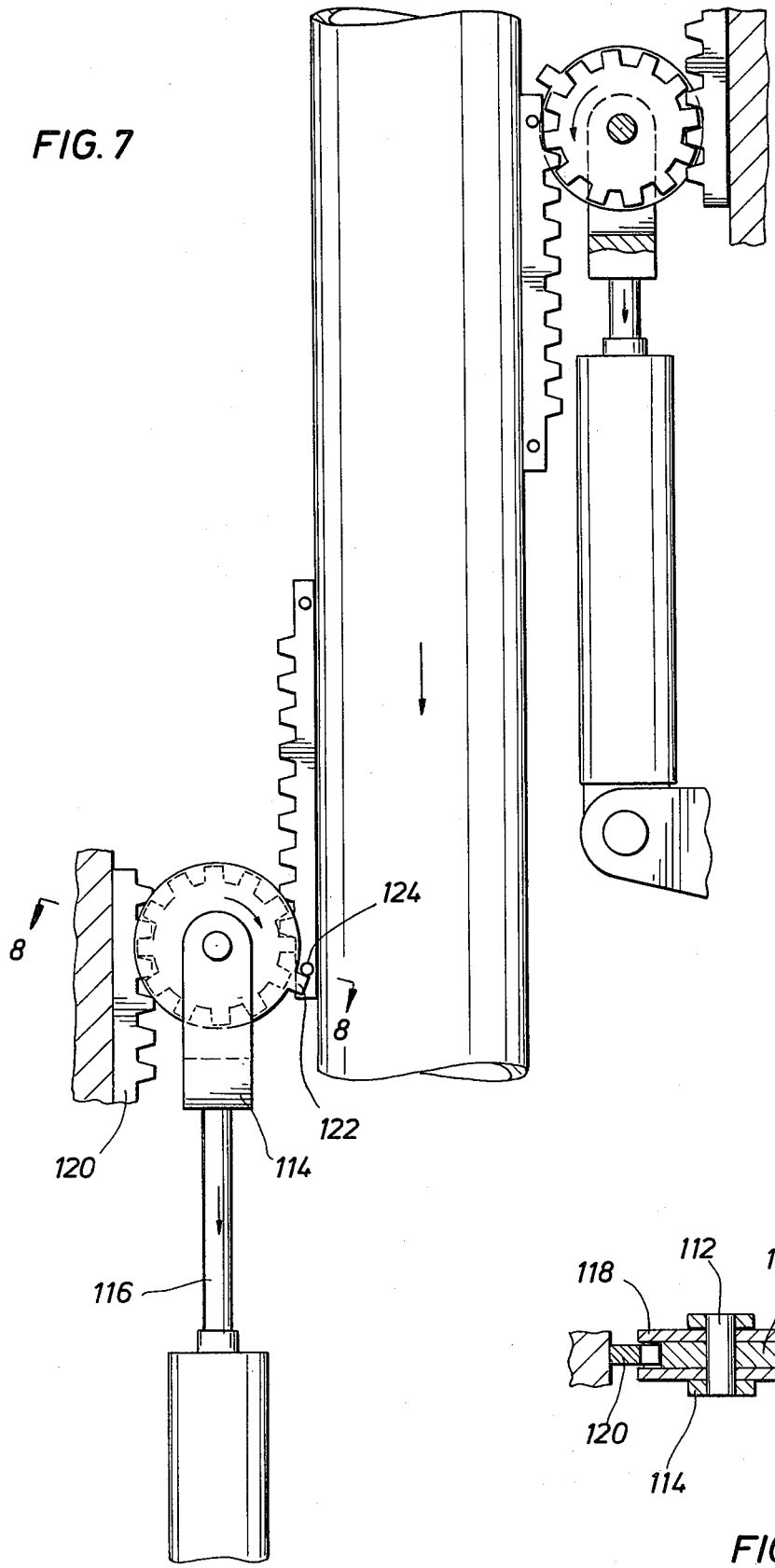
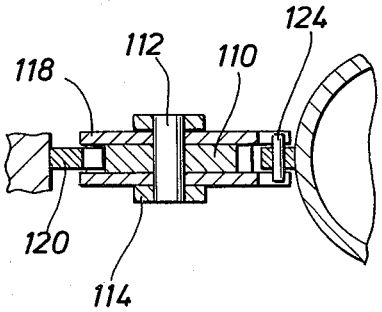
FIG. 8

BARGE JACKING APPARATUS

BACKGROUND OF THE DISCLOSURE

An offshore drilling barge of the jack-up variety is supported on three or more legs. Each leg may weigh as much as one million pounds. Legs of this size and weight are extremely difficult to move. The elevating mechanism, itself, often weighs many tons. The present invention is directed to a barge leg elevating mechanism which proficiently raises or lowers a leg. It cuts down on the weight of the equipment and the leg, thereby increasing the relative strength of the equipment or decreasing the cost of fabrication. Moreover, it raises and lowers the legs more rapidly.

BRIEF DESCRIPTION OF THE DISCLOSURE

The present invention is a barge leg jacking mechanism able to operate at increased rates of speed with a reduced weight of machinery and leg moving equipment. The increased speed is obtained by omitting portions of the side-located racks. The present apparatus utilizes two or more racks extending along a leg, the racks being equipped with teeth along the length thereof, except that significant portions of the racks are omitted. For each rack, more than fifty percent of its length can be omitted. The leg and attached rack pass through an opening in the barge, the opening enclosing a facing and cooperative rack. The cooperative rack on the barge is positioned opposite of the rack on the leg, and the two are engaged with one another by a pinion gear. The pinion is placed between the two racks by operation of a double-acting hydraulic cylinder equipped with a piston and piston rod. Under load, it extends at a relatively slow rate. Periodically, it runs to the end of the rack attached to the leg and is then free to move at a greater speed. Retraction or extension is then accelerated. Moreover, the pinion can be rapidly moved to a new position to reset itself for subsequent operation.

BRIEF DESCRIPTION OF THE DRAWINGS

FIG. 1 is a side view of an offshore drilling rig of the jack-up variety which incorporates jack-up legs which are constructed in accordance with the teachings of the present invention;

FIG. 2 is a plan view of the drilling rig shown in FIG. 1 showing three legs to support the barge;

FIG. 5 is a sectional view transverse to one of the legs showing an externally mounted rack on the leg;

FIG. 6 discloses a recessed rack and pinion arrangement as an alternative to the construction of FIG. 5;

FIG. 7 is an enlarged, detailed view of the invention and, in particular, discloses the interrupted rack of an alternate embodiment of the invention and the hydraulic piston and cylinder arrangement which extends a cooperative pinion for engagement with the rack; and FIG. 8 is a cross-sectional view taken along line 8—8 of FIG. 7 showing the gear and synchronizing lug of the alternate embodiment.

DETAILED DESCRIPTION OF THE ILLUSTRATED EMBODIMENT

Figure 3:
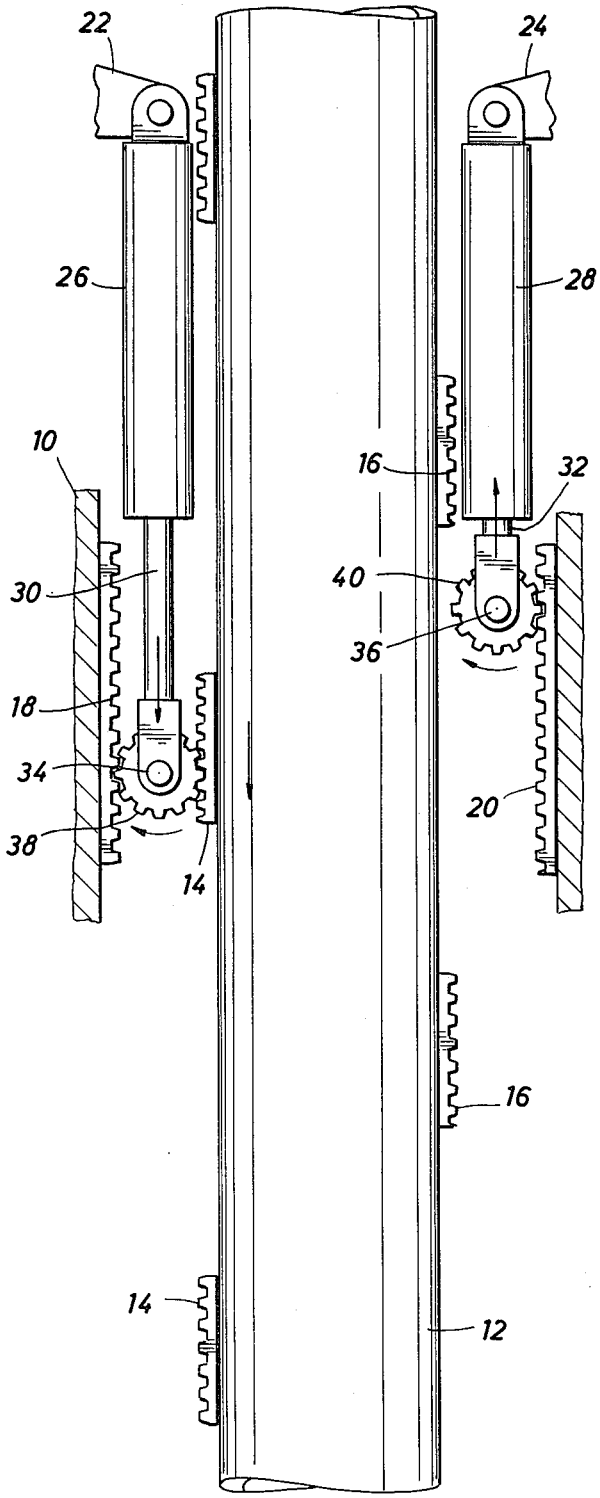
FIG. 3 is an enlarged, detailed view taken along the line 3—3 of FIG. 1 and, in particular, discloses the interrupted rack of the present invention and the hydraulic piston and cylinder arrangement which extends a cooperative pinion for engagement with the rack.

Attention is first directed to FIG. 1 of the drawings, where an offshore drilling rig is shown. A working platform 10 is supported on legs 12. There are identical legs, three or more in number, which support the platform 10. The legs extend downwardly and rest on the bottom of the body of water. They enable the platform 10 to be elevated above the water, indeed, above the wave action. The platform might eventually be supported fifty to one hundred feet above the level of the water on the legs which are beneath the platform. It will be appreciated that the platform is sizable, weighing several thousand tons. In like fashion, the legs 12 are quite sizable, standing between three and four hundred feet tall for larger rigs. Barge legs of this height can easily weigh one million pounds or more. FIG. 1 discloses the legs in a simplified form to be of cylindrical construction. In larger sizes, they are formed of an open latticework which might have three vertical columns of perhaps three or four feet in diameter and which describe an open latticework of perhaps 25.0 to 35.0 feet per side. Transverse and angular framework between the vertical columns defines the entirety of the leg. Whether a simple, cylindrical leg or an open lattice framework construction is used, the present invention is applicable to both. For the more complex and larger leg, the present apparatus is simply incorporated along the vertical columns which comprise the lattice framework of the jack-up leg.

At the time of elevating the barge 10, the legs 12 are moved relatively downwardly, and they rest on the bottom. They support the drilling platform 10 as it is raised by means of a raising mechanism in accordance with the teachings of this disclosure. This disclosure utilizes a hole through the platform 10 which is keyed to the shape of the leg. There, moderate clearance is provided, and the hole serves as a guide. More elaborate guide mechanisms can be used and are known in the art. Such guide mechanisms are incorporated by reference so that the leg is maintained in a specified angular position relative to the platform 10. Such a guide mechanism normally aligns the drilling platform 10 with the leg 12 by means of the opening through the drilling barge 10, alignment rollers, vertical bushings which lock against vertical surfaces on the leg and the like. They are incorporated by reference in the present disclosure and form cooperative apparatus for the elevating mechanism to be described. The present invention cooperates with this supporting equipment.

Figure 4:
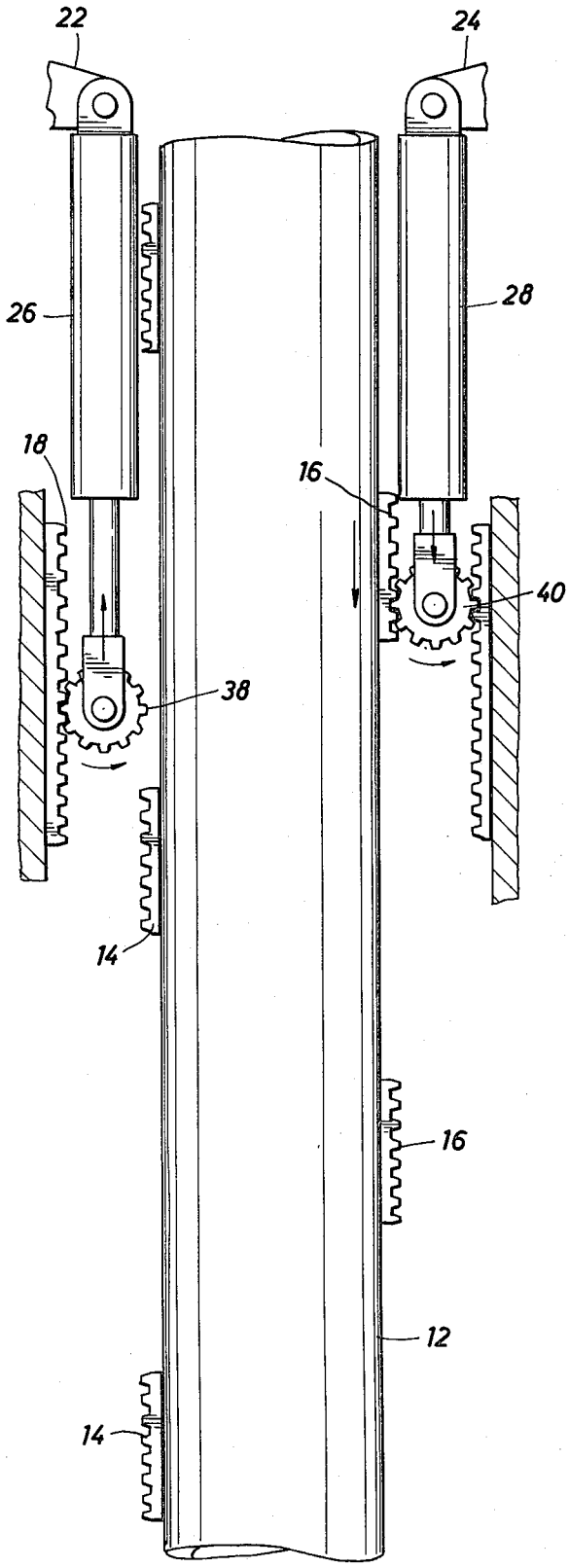
FIG. 4 is a view similar to FIG. 3 which shows relative movement of the leg downwardly and further discloses movement of the various rack portions and pinion gears engaged with them.

For a better understanding of the present invention, attention is next directed to FIGS. 3 and 4, jointly. The leg 12 has a left-hand rack 14 and a right-hand rack 16 typically arranged oppositely of one another. That is to say, they are approximately 180° apart relative to the leg 12. They may also be located closer to one another; it is assumed that the leg 12 is guided by a guide mechanism which limits movement of the leg along a specified locus through the drilling platform 10. The leg 12 in FIG. 3 can be the entire leg or only one corner of a framework. Canting and misalignment are accommodated by the guide means incorporated by reference. The two racks 14 and 16 are formed of rack elements. They are, however, materially separated by a significant space shown in FIG. 3 as a gap between the rack portions 14 on the right and 16 on the left. Rack portions 14 and 16 are carried on the leg and move with the leg. More will be noted concerning this hereinafter.

The barge 10 is viewed as a fixed structure, and, to this extent, the numeral 10 is incorporated in FIG. 3 to identify the barge, at least insofar as it provides a fixed portion cooperative with the present apparatus. The barge 10 supports a stationary rack 18 mounted adjacent to the left-hand rack 14 and a second stationary rack 20 mounted on the opposite side. Thus, the leg rack 14 faces the fixed or stationary rack 18. The leg rack 16 faces the stationary rack 20. Ideally, the racks 18 and 20 are equal in length and are equipped with teeth of equal pitch. They are also located at the same relative elevation on the platform 10. It will be understood that the racks 18 and 20 are located in a well extending from the top to the bottom of the drilling platform 10. The well is open to define a profiled opening in the rig where the leg 12 is operatively positioned. The leg 12 is received in the well so that the leg supported racks are immediately adjacent to and operatively positioned relative to the stationary racks 18 and 20.

Considering only the left-hand rack of FIG. 3, the numeral 22 identifies a rig supported mounting clevis. A similar clevis 24 is shown on the right. Each clevis supports an elongate, hydraulic cylinder 26 and 28, respectively, which, in turn, enclose or encase a piston. The piston is made double-acting by introducing hydraulic fluid at both ends of the cylinders. The pistons can be driven upwardly or downwardly as necessity dictates. The two cylinders 26 and 28 have sealed openings at the lower ends to enable piston rods 30 and 32 to extend downwardly. Each piston rod is connected to a suitable clevis which, in turn, supports a transverse mounting shaft. The left-hand shaft is identified by the numeral 34, and the right-hand shaft is 36. The left-hand shaft supports a pinion gear 38, while the right-hand shaft supports a pinion 40. The pinions 38 and 40 are preferably equal in diameter and have a pitch enabling their teeth to engage the racks 14 and 16 on the leg and the racks 18 and 20 on the barge.

Relative motion of the barge jacking apparatus can be understood in the following manner. The stationary rack 18 has a length which is greater than the length of the segments 14 which face it. If the segment 14 has a length of 2.0 meters, the rack 18 has a length of about 4.0 meters. These dimensions are not mandatory and are merely explanatory. The pinion 38 engages both racks 14 and 18 when both are in near proximity to the pinion and move along loci which carry them adjacent to the teeth of the pinion. Translation occurs in the following manner. If the piston rod 30 is extended by a length of 1.0 meter, it travels adjacent to 1.0 meter of the stationary rack 18. The rack 14, however, moves twice as far, assuming its length is sufficient to maintain engagement. This double-stroke arrangement occurs as a result of interposing the pinion 38 between the stationary rack 18 and the movable rack 14. The rate of movement of the leg, being twice the rate of extension of the piston rod 30, carries the leg 12 at an increased rate. As the leg 12 moves downwardly, the rack 16 is then brought into near proximity of the other hydraulic motor and associated pinion 40. Thus, the following sequence occurs. The piston rod 30 is extended to impart motion to the leg 12 at twice the rate of extension of the piston rod 30. Simultaneously, the piston rod 32 is able to be retracted at a very high rate of speed because there is no load on it. The pinion 40 rotates at a high rate of speed during retraction, the rack 16 being interrupted at this juncture as shown in FIG. 3. This carries the pinion 40 to the uppermost extreme of its stroke. Thus, the rack 20 has a length equal to or greater than the length of stroke of the hydraulic cylinder 28 on the right. Since symmetrical equipment is used on both sides, both hydraulic cylinders have a stroke length equal to or less than the associated stationary racks. This movement carries the pinion 40 to the uppermost position as shown in FIG. 3, where it is ready to operate.

In the upper position, the pinion 40 is then able to grab the rack 16 when it moves into the engaging position. This is illustrated in the transition set forth by contrasting FIGS. 3 and 4. That is to say, the pinion 40 picks up the rack 16 and drives it downwardly as shown in FIG. 4. This downward motion continues the leg motion which was obtained theretofore by the left-hand equipment, now disengaged. Disengagement is shown whereby the rack 14 is disengaged from the teeth of the pinion 38. The driving stroke is continued on the right, again moving the leg 12 at twice the rate of the downward stroke of the hydraulic cylinder 28.

The apparatus of the present invention thus drives the leg 12 at twice the speed of the hydraulic cylinders. In other words, if the cylinders extend at the rate of 1.0 meter per minute, the leg travels at the rate of 2.0 meters per minute. Moreover, the gaps in the racks 14 and 16 reduce the complexity of the equipment and enable a more rapid return. This is particularly shown in the contrast of the position of the pinion 38 between FIGS. 3 and 4. In FIG. 3, it travels downwardly until the rack 14 is forced completely from engagement. The rack 14 continues downwardly, and the gap thereafter is adjacent to the pinion 38. Disengagement then occurs as the leg supported rack travels beyond engagement with the pinion 38; at this juncture, the load experienced by the hydraulic cylinder is released, and it can retract quite rapidly. The return stroke is high speed, since it is free of loading. This then positions it in a ready position for subsequent engagement.

The progression of operation shown in FIGS. 3 and 4 is to extend the leg downwardly as will occur in elevating the barge. Movement in the opposite direction is accomplished in the same manner; the sequence is merely reversed.

The gap between rack segments 14 and rack segments 16 can, for example, be fifty percent or more of the possible rack length, assuming a solid rack extending up each side of the leg 12. The gap length is variable and may be greater than fifty percent of the possible rack length if desired. This is a tremendous reduction in cost, weight and complexity.

In FIG. 5 of the drawings, the rack is shown affixed to the exterior of the leg 12. The leg 12, as mentioned earlier, is a simplified solid leg of cylindrical construction. As mentioned earlier, an open latticework using three or four vertical columns can be used, and, in this regard, the external racks are located on the vertical columns in like fashion. FIG. 6 discloses an alternate embodiment, where the leg construction 50 utilizes a V-shaped, recessed cavity for the racks along the sides of the leg. The recess cuts down on the profile of the leg structure. The vertical racks, again, are disposed on opposite sides of the leg.

Another form of the leg may utilize four racks arranged at different locations around the periphery of the leg. Four racks to assure that two racks are always engaged while two are being reset and equalize side thrust on the leg. In the use of four racks, ideally, they are arranged at 90° intervals about the periphery of the leg. Moreover, with four racks, the force necessary to move the leg is applied at spaced, circumferential locations in the optimum arrangement whereby canting is prevented as a result of off-axis application of the motive force to elevate or retract the legs.

The present invention is particularly reduced in weight and complexity. It eliminates thousands of pounds from the leg of a jack-up barge. In addition, loading on the cylinder is always twice the leg load and the leg speed is always twice the cylinder speed. A very large pinion may be used which contributes to increased safety of the apparatus. Inasmuch as weight requires additional strength and greater weight elsewhere and further requires increased costs to manufacture the equipment, it is an economy in the construction and fabrication of jack-up barges.

Attention is directed to FIGS. 7 and 8 of this disclosure. They should be considered jointly. They disclose an embodiment which is identified by the numeral 100. The apparatus shown in those views is similar in construction to the disclosed apparatus of the earlier drawings except that a means is incorporated which prevents lateral slippage. The means alignes the pinion with the rack. Moreover, alignment is maintained at the start of each stroke, a stroke being defined as the meshing of the pinion with the rack. This is a power stroke at which time substantial loading occurs on the equipment. To this end, FIG. 7 discloses a pinion gear 110 which is mounted for rotation about the shaft 112 in a similar fashion to that shown in the earlier drawings. The shaft 112 is supported on a clevis 114, the clevis being supported on the end of a piston rod 116 shown in FIG. 7. The gear 110 is flanked on both sides by encircling solid disk 118. They are circular and are concentric about the shaft 112. The two are spaced so that they sandwich the gear 110 between them and moreover, define a receptable for the teeth of the pinion 120 shown in FIG. 7. The teeth of the pinion cannot slip to the right or left to engender accidental disengagement. The disk 118 thus serves to align the rack and pinion for certainty of engagement during the power stroke. Since the disk is duplicated on both sides, alignment is assured without slippage.

The disk is shown in FIG. 7 to be circular about its entire periphery except that a single lug 122 has been added. The lug 122 resembles a tooth on the pinion. It is located outboard from the pinion and extends past the teeth of the rack 120. It is located so that it extends adjacent to the side wall of the rack, and this location enables the lug or single tooth 122 to engage an alignment pin 124. The pin 124 is attached to the sides or flanks of the rack. Ideally, it extends through the rack and is located on both sides of the rack as shown in sectional view at FIG. 8. The pin 124 is thus located to align with single lugs on both sides of the rack. The single lugs move in unison. The disks 118 preferably being joined to one another by joinder to the pinion 110. In other words, the single lugs contact both ends of the pin 124 simultaneously.

Operation of the improved embodiment of FIGS. 7 and 8 should be considered. In particular, the pin 124 comes into play in the following manner. Imagine, for the moment, that the lower pinion of FIG. 7 is momentarily engaged with the left hand rack but is not engaged with the rack on the large leg. As the leg moves axially to bring the rack on the leg near to the pinion, the pin 124 moves along the locus of the lug 122. The pin 124 is located at the end of the rack beyond the teeth. A duplicate is located at the upper end and both are beyond the teeth. Upon engagement with the lug 122, the pin 124 aligns the pinion gear 110 for proper engagement with the rack. The size of the pinion gear 110 is such that it does not make a complete revolution as it rolls on the rack, thus, the lug 122 will not engage or interfere with the upper pin 124 when the pinion gear 110 disengages from the rack. The length of the cylinder stroke and the diameter of the pinion gear are adjusted to position the lug 122 for engaging a pin 124 located on the next approaching rack as the leg 12 is moved downwardly. In this manner, proper alignment of the rack and pinion is assured, thus reducing wear and tear of the gear teeth.

The foregoing is directed to the preferred embodiment, but the scope thereof is determined by the claims which follow.

I claim:

1. For use in a barge having a jack-up leg passing through a guide which secures the leg for movement toward or away from the underlying ground support beneath a body of water to raise or lower the barge relative to the body of water, the improved jack-up apparatus comprising:

(a) an elongate rack extending along a barge leg, said rack being intermittently interrupted and having two or more segments which are spaced from one another along the leg and which rack segments are aligned lengthwise with one another with a space between said segments;

(b) a stationary rack segment affixed to said barge, said stationary segment and leg segments being sized and arranged so that a pinion fits therebetween and engages both;

(c) a movable pinion having teeth with a pitch thereon to enable said pinion to engage said stationary segment and said rack segments; and (d) motor means connecting to said pinion for movement approximately parallel to the axis of said leg to move said pinion while engaging the teeth of said stationary rack to impart relative movement to said segmented rack.

2. The apparatus of claim 1 wherein said motor means comprises an extendable piston rod affixed to a piston and wherein the piston is received in a hydraulic cylinder for extension and retraction in response to hydraulic pressure imposed thereon.

3. The apparatus of claim 2 including a duplicate set of equipment on at least two portions of said leg where the duplicate set of equipment includes a second segmented rack and a second stationary rack.

4. The apparatus of claim 1 wherein said motor means includes (a) a barge supported connector means supporting an elongate cylinder;

(b) a piston rod extending therefrom and operably movable at the urging of a piston in said cylinder;

(c) an end-located clevis on said piston rod for said movable pinion; and (d) wherein said motor means has a stroke extending said movable pinion along said stationary rack for engagement and rotation during its stroke wherein said movable pinion rotates to thereby translate the leg by engagement with said segmented rack.

5. The apparatus of claim 4 wherein said connector means comprises a pivotal mounting aligned with said stationary rack.

6. The apparatus of claim 5 including first and second sets of duplicate, stationary racks arranged to cooperate with said segmented rack through first and second movable pinions.

7. The apparatus of claim 1 wherein said stationary rack and said segmented rack are positioned approximately parallel and are spaced apart by a distance permitting said movable pinion to fit therebetween and engage both of said racks.

8. The apparatus of claim 1 wherein the barge leg supports first and second segmented racks located on opposing sides of the leg.

9. The apparatus of claim 8 wherein each of said segmented racks comprises two or more longitudinally aligned rack portions.

10. The apparatus of claim 1 wherein said movable pinion has an adjacent alignment shoulder adapted to abut the edge of a rack to position the teeth of said pinion in meshed engagement with the teeth of either of said racks.

11. The apparatus of claim 10 wherein said alignment shoulder is formed on an adjacent encircling shoulder means extending above the heighth of the teeth on said pinion.

* * * * *